US006857904B2

(12) United States Patent
Lai

(10) Patent No.: US 6,857,904 B2
(45) Date of Patent: Feb. 22, 2005

(54) CABLE END CONNECTOR ASSEMBLY

(75) Inventor: Chin Te Lai, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/393,596

(22) Filed: Mar. 20, 2003

(65) Prior Publication Data

US 2004/0147167 A1 Jul. 29, 2004

(51) Int. Cl.[7] ..... H01R 9/03
(52) U.S. Cl. ..... 439/610
(58) Field of Search ..... 439/610, 607

(56) References Cited

U.S. PATENT DOCUMENTS 4,592,612 A * 6/1986 Kikuta ..... 439/610
5,092,794 A * 3/1992 Kachlic ..... 439/607
5,267,868 A * 12/1993 Wolff, Jr. ..... 439/95
5,338,227 A * 8/1994 Nakamura ..... 439/607
6,206,731 B1 * 3/2001 Kuo ..... 439/610

* cited by examiner

*Primary Examiner*—Phuong Dinh
(74) *Attorney, Agent, or Firm*—Wei Te Chung

(57) ABSTRACT

A cable end connector assembly (1) includes a cable end connector (10) and a cable (6). The cable end connector has an insulative housing (2), a plurality of contacts (31) received in the housing, and an integral shell (4) removably attached to the housing. The cable has a plurality of wires (63) respectively connecting to the contacts of the cable end connector and a shielding braid (62) enclosing the wires. The shell includes a first shielding portion (41) assembled to the housing, a second shielding portion (47) enclosing a section of the shielding braid, and a connecting portion (46) disposed therebetween for connecting the first and second shielding portions together.

15 Claims, 6 Drawing Sheets

CABLE END CONNECTOR ASSEMBLY

CROSS-REFERENCE TO RELATED APPLICATION

The patent application is relevant to a contemporaneously filed application having the same inventor, the same title and the same assignee as this patent application.

BACKGROUND OF THE INVENTION

1. Field of the Invention

The present invention relates to a cable end connector assembly, and more particularly to a cable end connector assembly having shielding means to prevent electromagnetic or radio frequency interference.

2. Description of Prior Art

Electrical connector assemblies are commonly used to connect external and internal peripheral devices to a computer for performing data transmission therebetween. The connector assembly typically employs a cable end connector assembly terminated with a transmission cable and a receptacle connector mounted on a printed circuit board of the computer and electrically connected with the cable end connector assembly. U.S. Pat. No. 6,299,487 discloses such a connector assembly with a cable end connector assembly and a receptacle connector. The cable end connector assembly includes a housing, a contact module disposed in the housing with a plurality of contacts retained therein, a shell partially insert-molded in the housing for eliminating electromagnetic interference of the contacts, and a cable with a distal end thereof electrically connecting to the contacts.

In the patent mentioned above, the contacts include signal contacts and grounding contacts. Each grounding contact has a large tail portion for receiving a grounding shield of the cable. In practice, other metal shells are provided to enclose wires of the cable with jacket being stripped off. Therefore, the data transmitting in the cable end connector and the cable is able to achieve a high reliability.

However, since the solution requires many metal shells and the grounding contacts have different configuration from the other contacts, the manufacturing and assembling process is complicated and therefore the cost of manufacture increases. Although there are many connectors with an integral shell for shielding in field, such as an electrical connector disclosed in U.S. Pat. No. 6,165,016, the shell is insert-molded in the housing such that it is not able to be reworked and replaced individually when the shell is defective. Thus, the entire cable end connector assembly has to be discarded, which in turn increases overall cost.

Hence, a cable end connector assembly with simple shielding means and removable shell is required to overcome the disadvantages of the prior art.

SUMMARY OF THE INVENTION

An object of the present invention is to provide a cable end connector assembly having a simple shielding means with a shell directly enclosing around a shielding braid of a cable, which can shield both contacts and cable to eliminate electromagnetic interference.

Another object of the present invention is to provide a cable end connector assembly with an integral removable shell for decreasing manufacture In order to achieve the objects set forth, a cable end connector assembly includes a cable end connector and a cable. The cable end connector has an insulative housing, a plurality of contacts received in the housing, and an integral shell removably attached to the housing. The cable has a plurality of wires respectively connecting to the contacts of the cable end connector and a shielding braid enclosing said wires. The shell includes a first shielding portion assembled to the housing, a second shielding portion enclosing a section of the shielding braid, and a connecting portion disposed therebetween for connecting the first and second shielding portions together.

Other objects, advantages and novel features of the invention will become more apparent from the following detailed description when taken in conjunction with the accompanying drawings.

DETAILED DESCRIPTION OF THE INVENTION

Figure 1:
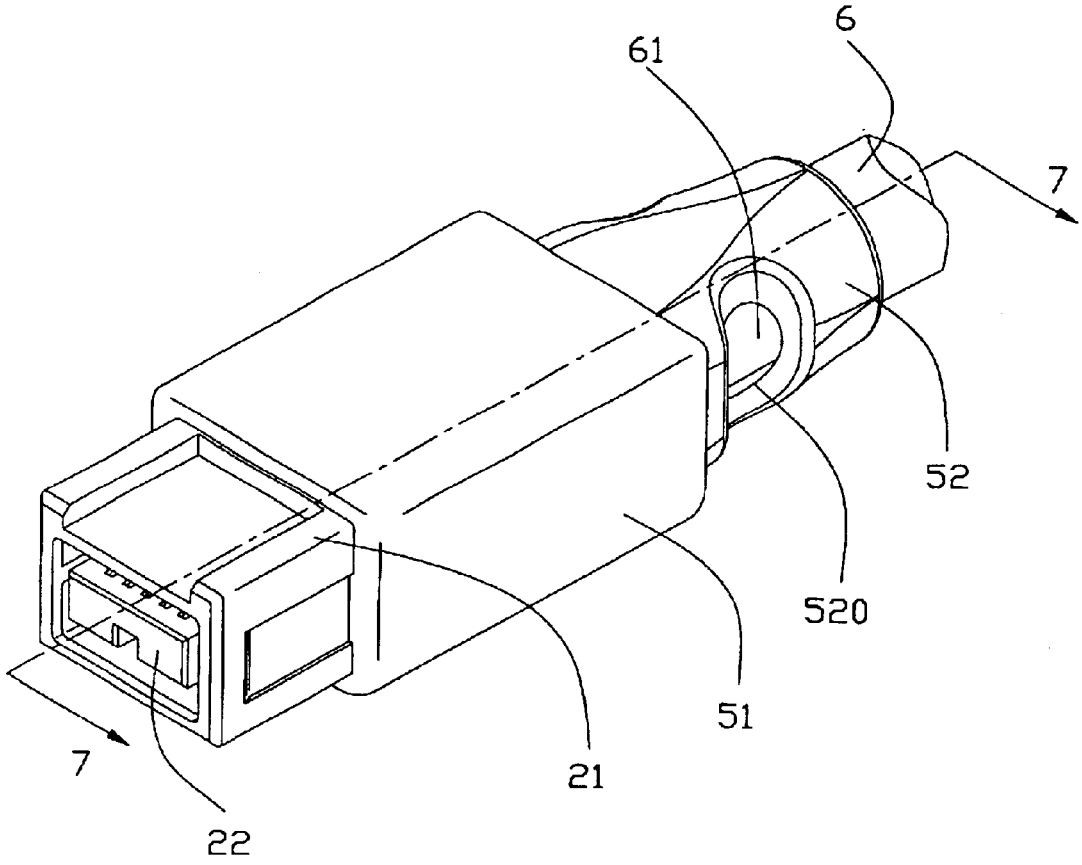
FIG. 1 is an assembled, perspective view of a cable end connector assembly in accordance with the present invention.
Figure 2:
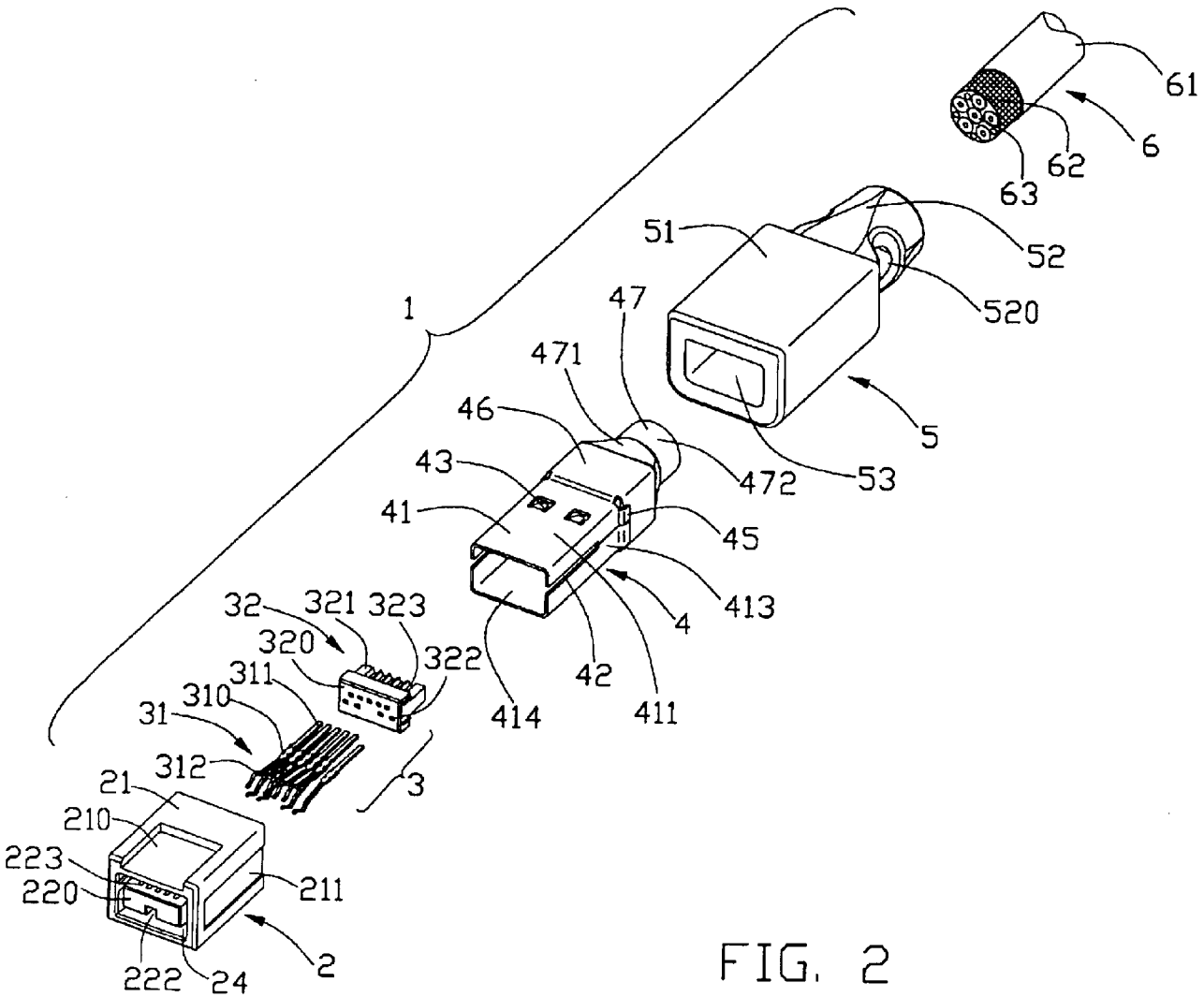
FIG. 2 is an exploded, perspective view of the cable end connector assembly of FIG. 1.
Figure 3:
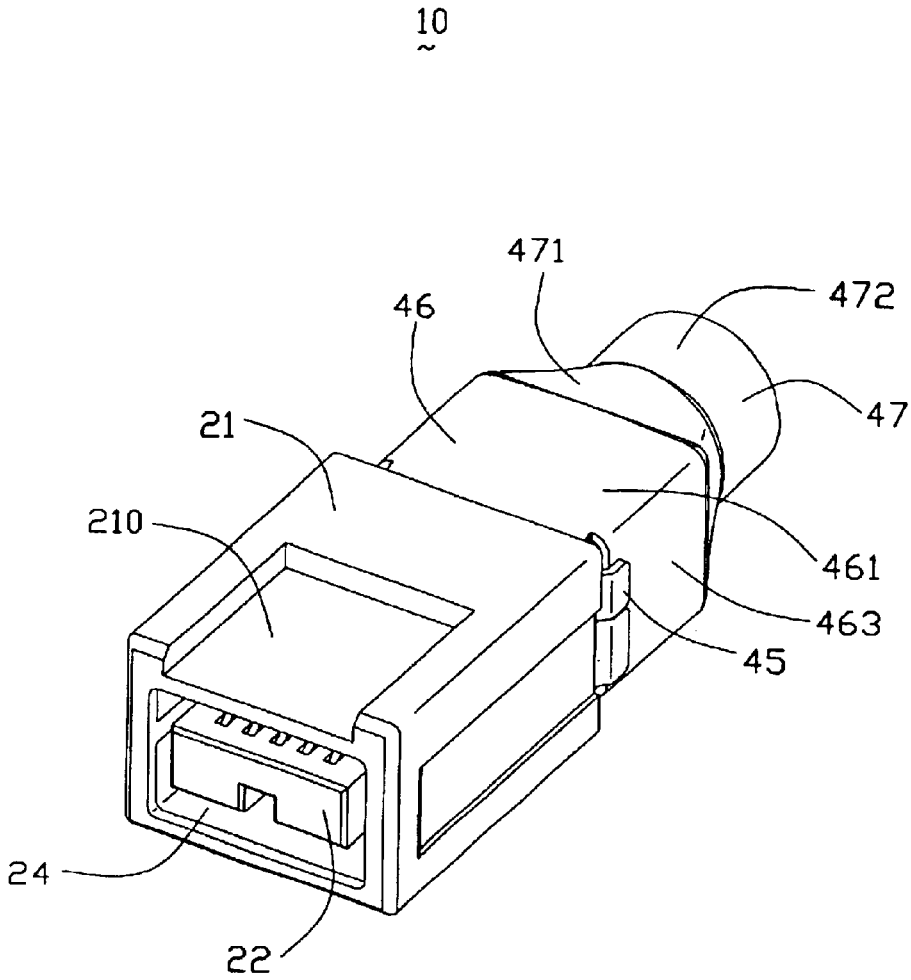
FIG. 3 is an assembled, perspective view of a contact module, housing and a shell of FIG. 1.
Figure 4:
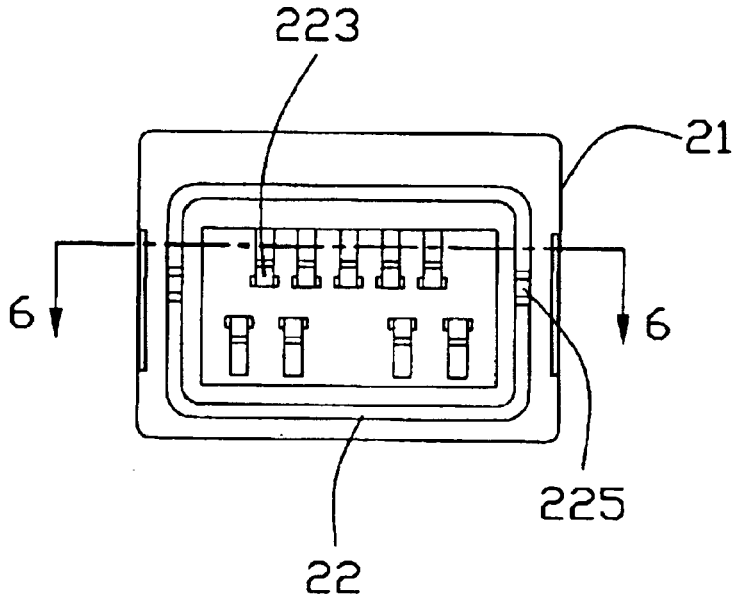
FIG. 4 is a rear view of a housing of the assembly in FIG. 1
Figure 5:
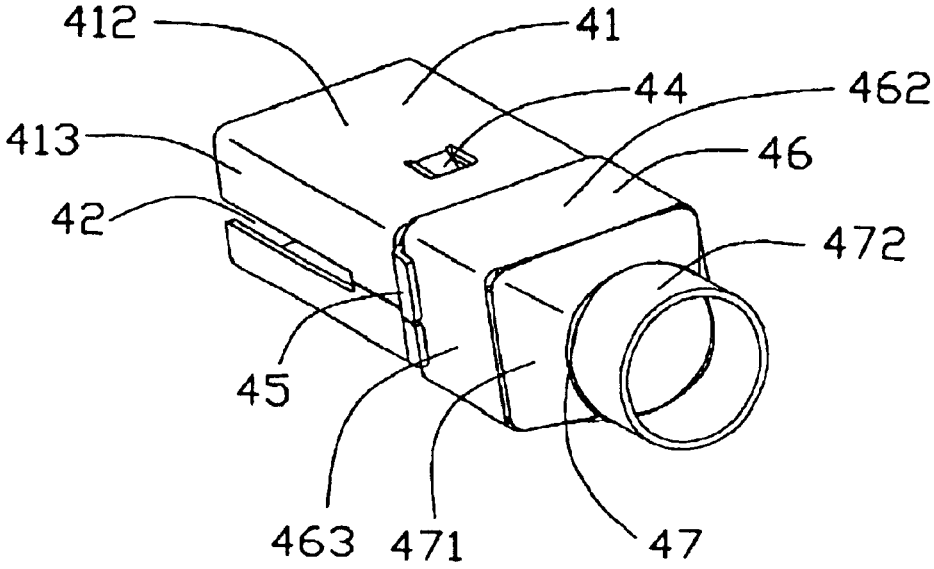
FIG. 5 is a perspective view of a shell of the assembly in FIG. 1 from another aspect.
Figure 6:
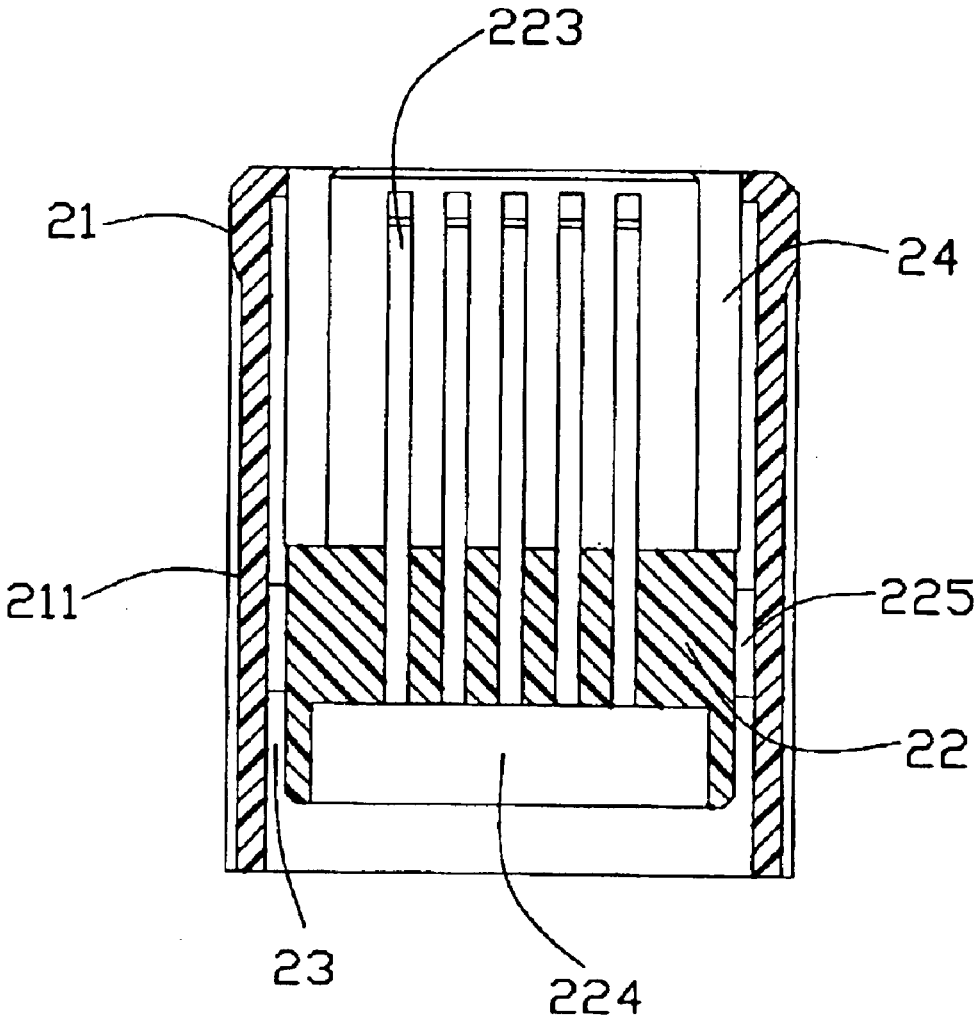
FIG. 6 is a cross-sectional view taken along line VI—VI of FIG. 4.

Referring to FIGS. 1 to 3, a cable end connector assembly 1 in accordance with the present invention complies with the specification of IEEE 1394b and includes a cable end connector 10, an insulative cover 5, and a cable 6. The cable end connector 10 includes an insulative housing 2, a contact module 3, and an integral shell 4.

In conjunction with FIGS. 4 to 7, the housing 2 includes a rectangular casing 21, a rectangular base 22 retained in the rectangular casing 21 and a tongue plate 220 extending forwardly from a front end of the rectangular base 22. The rectangular casing 21 defines a depression 210 in a top surface thereof and two recesses 211 in opposite side surfaces thereof. The rectangular base 22 and the rectangular casing 21 define a generally annular receiving slit 23 therebetween. The tongue plate 220 and the rectangular casing 21 define a receiving space 24 therebetween connecting with the receiving slit 23 for receiving a mating portion of a complementary receptacle connector (not shown). Two elongated ribs 225 are formed between the rectangular base 22 and the rectangular casing 21 for connecting the rectangular base 22 and the rectangular casing 21 together. The rectangular base 22 defines a pair of elongated grooves 226 on an upper surface thereof and one of the ribs 225 between the grooves 226, and a receiving concave 224 on a rear surface thereof.

The tongue plate 220 defines a plurality of passageways 223 in opposite upper and lower surfaces thereof. The passageways 223 communicate with the concave 224 and the receiving space 24. In addition, the tongue plate 220 defines an elongated recess 222 in the middle of the lower surface thereof for engagably receiving a corresponding portion of the complementary receptacle connector.

Also referring to FIG. 3, the contact module 3 includes a contact holder 32 and a plurality of contacts 31 assembled to the contact holder 32. The contact holder 32 is generally T-shaped and includes a main portion 320 and a retention portion 321 extending rearward from a rear surface of the main portion 320. The main portion 320 defines a plurality of slots 322 extending along a front-to-rear direction. The retention portion 321 defines a plurality of apertures 323 on a top surface thereof communicating with the slots 322. The contacts 31 include signal contacts, grounding contacts, power contacts, and so on. The arrangement of these different types of contacts complies with the specification of IEEE 1394b, and here will not describe any more. All of the contacts 31 have the same configuration, and each contact 31 includes a contacting portion 312, a retaining portion 310 extending rearward from a rear end of the contacting portion 312, and a tail portion 311 extending rearward from a rear end of the retaining portion 310. The shell 4 is stamped from a metal sheet and includes a first shielding portion 41, a second shielding portion 47, and a connecting portion 46 between the first and second shielding portions 41, 47 for connecting the first and second shielding portion 41, 47 together. The connecting portion 46 and the second shielding portion 47 extend rearwardly from the first shielding portion 41 by extrusion. The first shielding portion 41 has an upper wall 411, an opposite lower wall 412, and two side walls 413 connecting with the upper and lower walls 411, 412. The upper, lower and two side walls 411, 412, 413 together define a receiving room 414 therebetween. The two side walls 413 each defines a slit 42 extending rearwardly from the front end to the middle portion thereof. A pair of spring tabs 43 are bent obliquely and inwardly from the upper wall 411 and such defines a pair of openings 420 on the upper wall 411. Similarly, a tab 44 extends inwardly into the receiving room 414 from the lower wall 412. The connecting portion 46 and the second shielding portion 47 extend rearwardly from the first shielding portion 41. The connecting portion 46 is a rectangular configuration and includes a top wall 461, a lower wall 462 extending rearwardly from the upper wall 411 and the lower wall 412, and a pair of connecting walls 463 connect the top wall 461 and lower wall 462. Each side wall 413 of the first shielding portion 41 forms a pair of flexible tabs 45 extending rearwardly from the rear end of the side wall 413 and resting against the connecting portion 46. The second shielding portion 47 extends rearwardly from the connecting portion 46 and includes a funnel-shaped continuing portion 471 and a cylinder-shaped tail portion 472 extending rearwardly from the continuing portion 471.

The cable 6 includes a plurality of wires 63, a metal shielding braid 62 enclosing the wires 63, and an insulative jacket 61 enclosing the shielding braid 62. The wires 63 include signal wires, grounding wires, and power wires corresponding to the signal contacts, grounding contacts, and power contacts respectively. The arrangement of the different types of the wires also complies with the specification of IEEE 1394b, and here will not further describe either.

The insulative cover 5 is over-molded and includes a cuboid-shaped front portion 51 and a generally columnar rear portion 52. The front portion 51 defines a cavity 53 therein for receiving a rear portion of the connector 10 and a front end of the cable 6. The rear portion 52 defines a pair of opposite holes 520 in opposite sides thereof to function as a strain relief.

Figure 7:
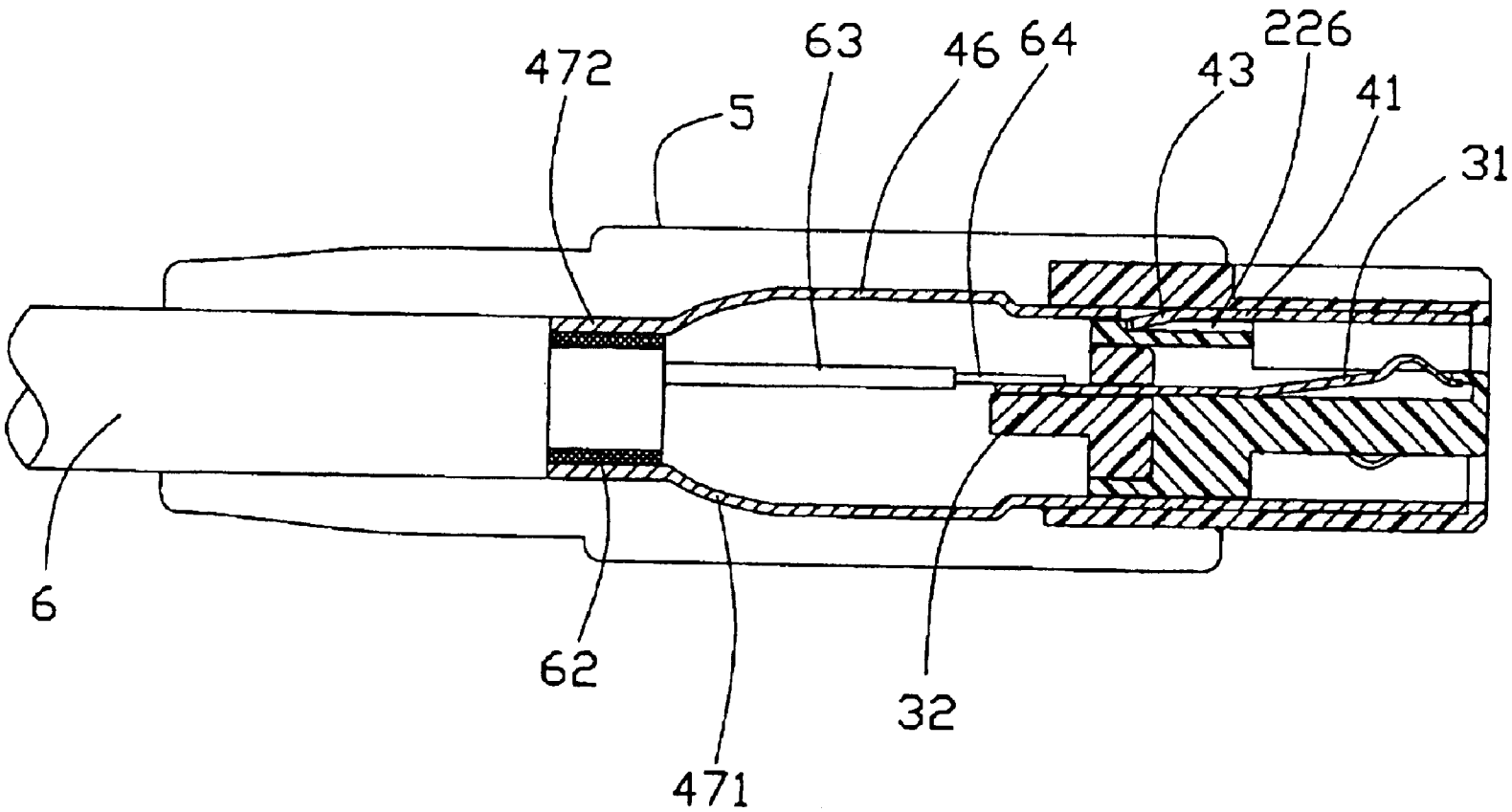
FIG. 7 is a cross-sectional view taken along line VII—VII of FIG. 1.

Referring to FIGS. 2, 3 and 7. In assembly, firstly, the contacts 31 are inserted into the contact holder 32 to form the contact module 3 with the retaining portion 310 retained in the corresponding slot 322 of the contact holder 32, the tail portion 311 received in the same slot 322 of the contact holder 32 and the contacting portion 312 extending beyond a front end of the main portion 320. Secondly, the contact module 3 is assembled to the housing 2 along a rear-to-front direction. The main portion 320 of the contact holder 32 is received in the concave 224 of the base 22, and the contacting portion 312 of each contact 31 extends through the concave 224 of the base 22 and is received in a corresponding passageway 223 of the tongue plate 220 for electrically connecting to the complementary connector. Thirdly, the shell 4 is inserted into the housing 2 along a rear-to-front direction. The first shielding portion 41 extends through the receiving slit 23 and the receiving space 24 and reach to a front end of the housing 2 to shield the contacts for eliminating electromagnetic interference. The two ribs 225 of the housing 2 are received in corresponding slit 42 of the shell 4 to guide the shell 4 into the housing 2.

When the shell 4 is completely assembled to the housing 2, the spring tabs 43 bent obliquely and inwardly from the upper wall 41 of the shell 4 are received in corresponding grooves 226 defined on the upper surface of the base 22 with the free end of the spring tabs 43 abutting the base 22 at rear end of the grooves 226 to prevent the shell 4 moving rearward, the tab 44 of the lower wall 412 abutted on corresponding grooves of the lower surface of the base 22, and the pair of flexible tabs 45 of each side wall 413 abut against the rear end of the side wall of the insulative housing 21 to prevent the shell moving forwardly. Thus, the shell 4 is secured to the housing 2. By this means, the shell 4 can be assembled to the housing 2 readily and retained in the housing 2 securely. If the shell 4 is inferior in manufacturing, an external tool (not shown), such as a screwdriver, is inserted into the grooves 226 from a front end of the receiving space 24 and pressed the free end of the spring tabs 42 and 43 to drive it to be deformed upward and out of the grooves 226, thereby, pulling the shell 4 backward. Therefore, the shell 4 is able to be removed from the housing 2 readily and be reworked and replaced individually.

Finally, the cable 6 is assembled to the cable end connector 10. An end portion of the jacket 61 of the cable 6 is stripped off to expose the shielding braid 62 and a part of the exposed shielding braid 62 is stripped off to expose the wires 63. The wires 63 are soldered to the tail portions 311 of corresponding contacts 31. The section of the shielding braid 62 still exposing outside positions above the second shielding portion 47 of the shell 4. Then, the connecting portion 46 of the shell 4 encloses the front end extending beyond the jacket 61 of the wires 63, and the tail portion 472 of the second shielding portion 47 defining a circular space for receiving which of the shielding braid 62. The insulative cover 5 is over-molded to the connection between the cable end connector 10 and the cable 6. The front portion 51 encloses the rear portion of the connector 10 and the front end portion of the cable 6, and the rear portion 52 encloses the insulative jacket 61 of the cable 6 to function as a strain relief.

Compare with the shielding means mentioned in the prior art, the present invention provides an integral shell which is able to shield both the contacts and the cable instead of a plurality of metal shells described in the prior art, and the contacts with different usage have the same configuration, therefore, the manufacturing and assembling process is simplified and thereby reducing the manufacture cost. In addition, the shell can assembled to and removed from the housing readily, so the cable end connector assembly in accordance with the present invention need not to be discarded entirely just for the shell thereof being unqualified, thereby, the manufacturing cost will further reduce.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

a cable end connector comprising an insulative housing, a plurality of contacts received in the housing, and a shell, said housing defining a receiving slit therein; and a cable comprising a plurality of wires respectively connecting to said contacts of the cable end connector and a shielding braid enclosing said wires; wherein said shell comprising a first shielding portion assembled to the housing, a second shielding portion enclosing the shielding braid, and a connecting portion connected between the first and second shielding portions, the first shielding portion extending through said receiving slit to shield said contacts; wherein said cable end connector comprises a holder for retaining the contacts; wherein said housing comprises a base for retaining the holder, a tongue plate extending from the base and a casing around the base and the tongue plate, said receiving slit being defined between the base and the casing; wherein said housing comprises a pair of ribs connecting the base and the casing together; wherein said shell comprises slit for receiving the ribs.

2. The cable end connector assembly as claimed in claim 1, wherein said cable comprises a jacket enclosing the shielding braid.

3. The cable end connector assembly as claimed in claim 1, wherein said second shielding portion comprises a funnel-shaped portion and a cylinder-shaped tail portion, the tail portion defining a receiving space for receiving the shielding braid of the cable.

4. The cable end connector assembly as claimed in claim 1, wherein said first shielding portion comprises an upper wall, a lower wall and a pair of side walls together defining a receiving space.

5. The cable end connector assembly as claimed in claim 4, wherein said upper wall and said lower wall form at least one tab extending inwardly into the receiving space, and each side wall has at least one flexible tab at a rear end thereof abutting against a front end of the connecting portion.

6. The cable end connector assembly as claimed in claim 1, wherein said base defines a concavity on a rear surface thereof for receiving the holder.

7. The cable end connector assembly as claimed in claim 1, further comprising an insulative cover over-molding a rear portion of the housing and a junction portion between the cable end connector and the cable.

8. A cable end connector assembly comprising:

a cable end connector including an insulative housing defining an outer casing and an inner base assembly essentially circumferentially spaced from each other by a receiving slit while connected with each other by a pair of opposite ribs on two sides;

a plurality of terminals disposed in the housing;

a cable including a plurality of wires connected to the corresponding terminals, respectively;

a tubular type metallic shell defining loop/closed type cross-sections along a front-to-back direction wherein a rectangular cross-section is formed in a front portion, a circular cross-section is formed in a rear portion, and a conic cross-section is formed in a median portion; wherein said front portion defines a pair of slits with openings in front ends thereof so that the shell is able to be forwardly inserted into the receiving slits from a rear face of the housing until the ribs are respectively properly received in the corresponding slits.

9. The assembly as claimed in claim 8, wherein said front portion encloses the base, said rear portion grasps the cable, and said median portion encloses the exposed wires which are located outside of an outer jacket of the cable.

10. A cable end connector assembly comprising:

a cable end connector comprising an insulative housing, a plurality of contacts received in the housing, a holder for retaining the contacts and a shell; and a cable comprising a plurality of wires respectively connecting to said contacts of the cable end connector and a shielding braid enclosing said wires; wherein said housing comprising a base for retaining the holder, a tongue plate. extending from the base, a casing around the base and the tongue plate, and a pair of ribs connecting the base and the casing together;

said shell comprising a first shielding portion assembled to the housing, a second shielding portion enclosing the shielding braid, a connecting portion connected between the first and second shielding portions, and slits for receiving the ribs.

11. The cable end connector assembly as claimed in claim 10, wherein said second shielding portion comprises a funnel-shaped portion and a cylinder-shaped tail portion, the tail portion defining a receiving space for receiving the shielding braid of the cable.

12. The cable end connector assembly as claimed in claim 10, wherein said first shielding portion comprises an upper wall, a lower wall and a pair of side walls together defining a receiving space.

13. The cable end connector assembly as claimed in claim 12, wherein said upper wall and said lower wall form at least one tab extending inwardly into the receiving space, and each side wall has at least one flexible tab at a rear end thereof abutting against a front end of the connecting portion.

14. The cable end connector assembly as claimed in claim 12, wherein said side walls each defines a slit extending rearwardly from the front end to approximate a middle portion thereof.

15. The cable end connector assembly as claimed in claim 10, wherein said base defines a concavity on a rear surface thereof for receiving the holder.

* * * * *